US006282399B1

(12) United States Patent
Tokimatsu et al.

(10) Patent No.: US 6,282,399 B1
(45) Date of Patent: Aug. 28, 2001

(54) FIXING APPARATUS

(75) Inventors: Hiroyuki Tokimatsu; Satoshi Haneda, both of Hachioji (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 09/568,117

(22) Filed: May 10, 2000

(30) Foreign Application Priority Data

May 17, 1999 (JP) ..... 11-135604

(51) Int. Cl.[7] ..... G03G 15/20
(52) U.S. Cl. ..... 399/330; 399/333; 399/336
(58) Field of Search ..... 399/328, 330, 399/335, 336, 338, 333; 219/216, 469

(56) References Cited

U.S. PATENT DOCUMENTS 5,774,763 * 6/1998 Muramatsu ..... 399/328 X
6,085,059 * 7/2000 Haneda et al. ..... 399/333
6,157,805 * 12/2000 Haneda et al. ..... 399/328
6,205,301 * 3/2001 Shigeta et al. ..... 399/66

FOREIGN PATENT DOCUMENTS 52-106741 9/1977 (JP) .
57-82240 5/1982 (JP) .
57-102736 6/1982 (JP) .
57-102741 6/1982 (JP) .
59-65867 4/1984 (JP) .

* cited by examiner

*Primary Examiner*—Fred L. Braun
(74) *Attorney, Agent, or Firm*—Frishauf, Holtz, Goodman, Langer & Chick, P.C.

(57) ABSTRACT

A fixing apparatus that fixes, on a transfer material, toner images on the transfer material through heating and pressing, wherein, a ray-radiating member that radiates rays is provided, and a roll-shaped rotary member for applying heat is formed by providing a cylindrical ray-transmitting base member which can transmit the rays and a cylindrical ray-transmitting elastic layer or a ray-transmitting heat insulating layer which can transmit the rays, and by providing, on the outer side of the ray-transmitting elastic layer or the ray-transmitting heat insulating layer, a ray absorbing layer that absorbs the rays stated above. The inequality of T1<T2<T3 holds when T1 (°) represents an average temperature in the layer of the ray-transmitting base member, T2 (°) represents an average temperature in the layer of the ray-transmitting elastic layer or the ray-transmitting heat insulating layer, and T3 (°) represents an average temperature in the layer of the ray absorbing layer during a warm-up.

12 Claims, 6 Drawing Sheets

FIXING APPARATUS

BACKGROUND OF THE INVENTION

The present invention relates to a fixing apparatus for use in an image forming apparatus such as a copying machine, printer, facsimile device, etc., and more particularly, to a fixing apparatus capable of starting quickly.

Conventionally, as a fixing apparatus for use in an image forming apparatus such as a copying machine, a printer, a facsimile device, or the like, a heat roller fixing type device is widely adopted from a low speed apparatus to a high speed apparatus, and from a monochromatic apparatus to a full-color apparatus, as the fixing apparatus which has the high technical complication degree and stability.

However, in the conventional heat roller fixing type fixing apparatus, when transfer material or toner is heated, it is necessary that a fixing roller having a large thermal capacity is heated, therefore, the effect of energy conservation is not good, and it is disadvantageous to the phase of the energy conservation, and when printing, it takes a long period of time to warm up the fixing apparatus, therefore the print time (warming up time) takes a long period of time, which is a problem.

In order to solve these problems, a film fixing type fixing apparatus in which a film (heat fixing film) is used, and the thickness of the heat roller is decreased to that of heat fixing film which is the ultimate thickness and the thermal capacity of the heat roller is decreased, and heat conduction efficiency is greatly improved by directly pressure-contacting the temperature controlled-heater (ceramic heater) onto the heat fixing film, and the energy conservation and the quick start which requires almost no warming-up time are intended, and an image forming apparatus therewith are proposed and used recently.

Further, a fixing method in which, as a variation of the heat roller, a ray-transmitting base member is used as a ray radiating roller (a rotary member for applying heat), and a ray from a halogen lamp (ray radiating means) provided inside the heat roller is radiated on toner for heat fixing, and the quick start which requires almost no warming-up time, is intended, is disclosed in Japanese Tokkaisho No. 52-106741, No. 57-82240, No. 57-102736, No. 57-102741, etc. Further, a fixing method, in which a ray absorbing layer is provided on outer peripheral surface of the ray-transmitting base member and thereby, the ray irradiating roller (a rotary member for applying heat) is structured, and a ray from a halogen lamp (ray radiating means) provided inside the cylindrical ray-transmitting base member is absorbed in the ray absorbing layer provided on the outer peripheral surface of the ray-transmitting base member, and the toner image is fixed by the heat of the ray-absorbing layer, is disclosed in Japanese Tokkaisho No. 59-65867.

However, in the fixing apparatus disclosed in Japanese Tokkaisho No. 52-106741, the quick start wherein energy conservation and reduction of warming-up time are attained is intended through a method to heat and fix toner by irradiating through a ray-transmitting base member with a ray from a halogen lamp (ray radiating means), while, in the fixing apparatus disclosed in Japanese Tokkaisho No. 59-65867, the quick start is intended through a method in which a light absorbing layer (ray absorbing layer) is provided on outer peripheral surface of the ray-transmitting base member, thereby, the ray irradiating roller (a rotary member for applying heat) is structured, and a ray from a halogen lamp (ray radiating means) is radiated through the ray-transmitting base member onto the ray absorbing layer, so that the toner is fixed by the heat of the ray-absorbing layer, the energy conservation and the quick start in which the warm-up time is reduced. However, the method using only heat generation from the ray absorbing layer on the surface has problems that the temperature of the lower portion of the ray absorbing layer is low, and the temperature of the ray absorbing layer suddenly falls when making prints, and the hysteresis on the portion where a transfer material passes remains for a long time, causing temperature fluctuation on the rotary member for applying heat, although the warming-up time can be shortened.

Further, since a cylindrical glass member is used mainly as a material of the ray-transmitting base member, there are caused problems that the cylindrical accuracy (circularity and cylindricity of an outer circumferential cylinder) of the ray-transmitting base member is poor, and thereby, pressure force and rotation of a rotary member for applying heat lack evenness, which tends to cause uneven fixing.

SUMMARY OF THE INVENTION

An object of the invention is to solve the problems stated above, and to provide a fixing apparatus wherein a warming-up time is short, a temperature fall of a ray absorbing layer in the course of printing and temperature hysteresis at the location through which a transfer material passes are prevented, and a temperature of a rotary member for applying heat is stabilized.

Another object of the invention is to solve the problems mentioned above and to provide a fixing apparatus wherein a rotary member for applying heat having excellent cylindrical accuracy is formed and uneven fixing is prevented accordingly.

The objects stated above are attained by a fixing apparatus that fixes, on a transfer material, toner images staying on the transfer material through heating and pressing, wherein, a ray-radiating means that radiates rays is provided, and a roll-shaped rotary member for applying heat is formed by providing a cylindrical ray-transmitting base member which can transmit the rays mentioned above and. a cylindrical ray-transmitting elastic layer or a ray-transmitting heat insulating layer which can transmit the rays mentioned above, and by providing, on the outer side of the aforesaid ray-transmitting elastic layer or the ray-transmitting heat insulating layer, a ray absorbing layer that absorbs the rays stated above, and the inequality of $T1<T2<T3$ holds wherein T1 (°) represents an average temperature in the layer of the ray-transmitting base member, T2 (°) represents an average temperature in the layer of the ray-transmitting elastic layer or the ray-transmitting heat insulating layer, and T3 (°) represents an average temperature in the layer of the ray absorbing layer, in the case of temperature rise.

Further, the objects stated above are attained by a fixing apparatus that fixes, on a transfer material, toner images staying on the transfer material through heating and pressing, wherein, a ray-radiating means that radiates rays is provided, and a roll-shaped rotary member for applying heat is formed by providing a cylindrical ray-transmitting base member which can transmit the rays mentioned above and a cylindrical ray-transmitting elastic layer or a ray-transmitting heat insulating layer which can transmit the rays mentioned above, and by providing, on the outer side of the aforesaid ray-transmitting elastic layer or the ray-transmitting heat insulating layer, a ray absorbing layer that absorbs the rays stated above, and the inequality of $T11<T21<T31$ holds wherein T11 (°) represents a temperature raised per unit time for the aforesaid ray-transmitting base member alone, T21 (°) represents a temperature raised per unit time for the aforesaid ray-transmitting elastic layer or the ray-transmitting heat insulating layer alone, and T31 (°) represents a temperature raised per unit time for the aforesaid ray absorbing layer alone.

Further, the objects stated above are attained by a fixing apparatus that fixes, on a transfer material, toner images staying on the transfer material through heating and pressing, wherein, a ray-radiating means that radiates rays is provided, and a roll-shaped rotary member for applying heat is formed by providing a cylindrical ray-transmitting base member which can transmit the rays mentioned above and a cylindrical ray-transmitting elastic layer or a ray-transmitting heat insulating layer which can transmit the rays mentioned above, and by providing, on the outer side of the aforesaid ray-transmitting elastic layer or the ray-transmitting heat insulating layer, a ray absorbing layer that absorbs the rays stated above, and the inequality of $\alpha1<\alpha2<\alpha3$ holds when $\alpha1$ ($mm^{-1}$) represents the ray absorption coefficient of the aforesaid ray-transmitting base member, $\alpha2$ ($mm^{-1}$) represents the ray absorption coefficient of the aforesaid ray-transmitting elastic layer or the aforesaid ray-transmitting heat insulating layer, and $\alpha3$ ($mm^{-1}$) represents the ray absorption coefficient of the aforesaid ray absorbing layer.

Further, the objects stated above is attained by a fixing apparatus that fixes, on a transfer material, toner images staying on the transfer material through heating and pressing, wherein, a roll-shaped rotary member for applying heat is formed, by providing a ray-radiating means which radiates rays, a cylindrical ray-transmitting base member which is arranged around the ray-radiating means and is ray-transmitting for the aforesaid rays, a ray-transmitting elastic layer arranged outside the ray-transmitting base member, and a ray absorbing layer which is arranged outside the elastic layer and absorbs the rays, and a thickness of the elastic layer is made to be three times or more a value of circularity of an outer circumferential cylinder of the ray-transmitting base member.

Figure 3:
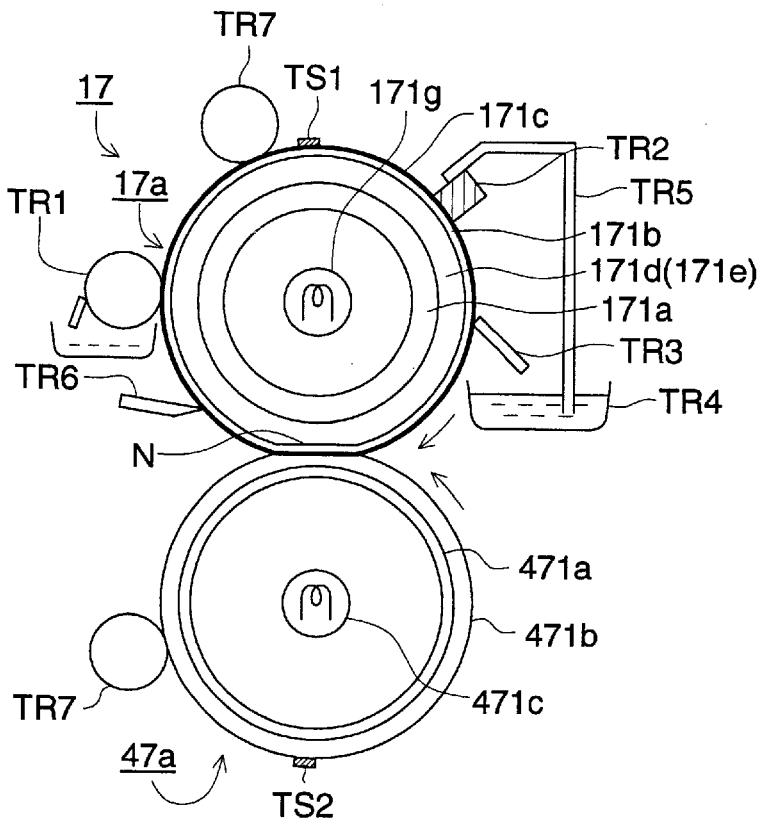
FIG. 3 is an illustration showing the structure of a fixing apparatus.
Figure 4:
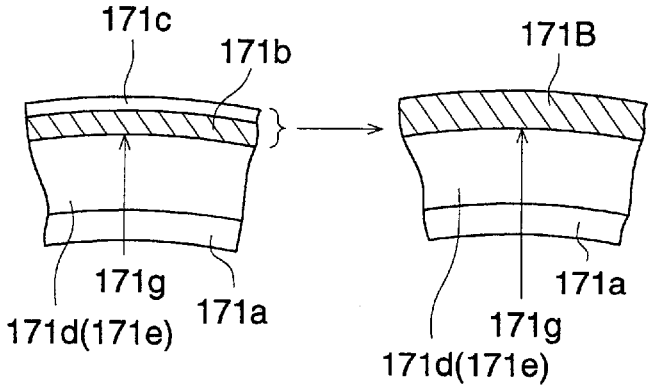

Each of FIG. 4(*a*) and FIG. 4(*b*) is an enlarged sectional structure diagram of a roll-shaped rotary member for applying heat in FIG. 3.

Figure 5:
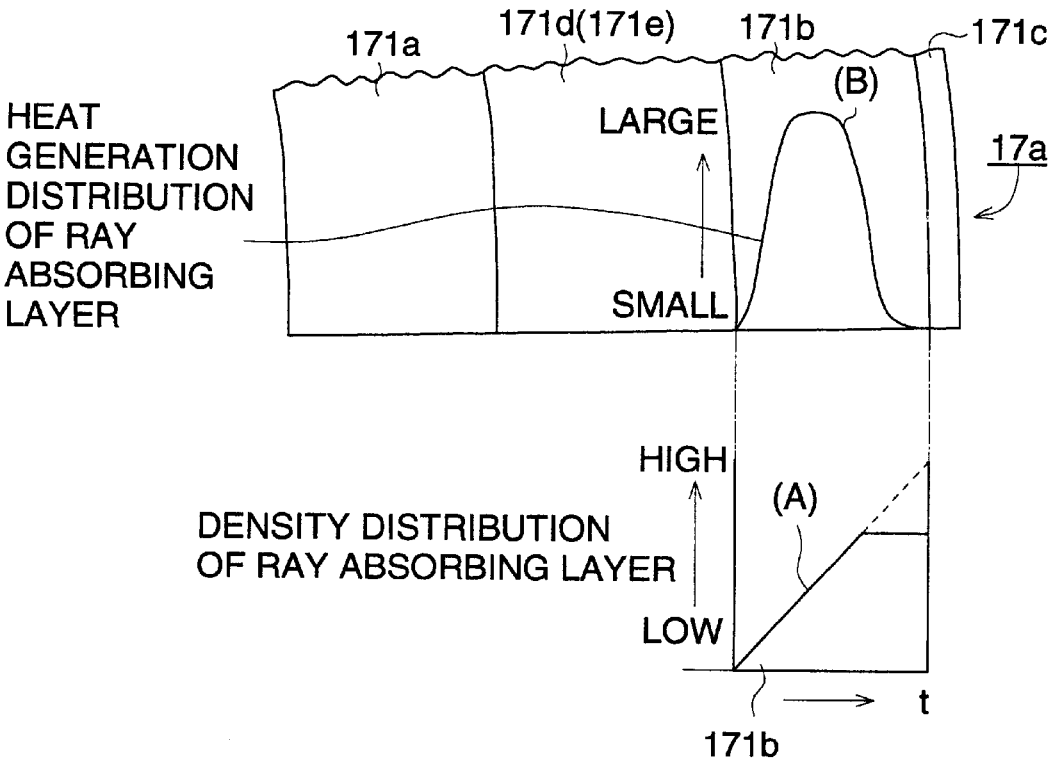

FIG. 5 is a diagram showing density distribution of a ray absorbing layer of the roll-shaped rotary member for applying heat in FIG. 3.

Figure 6:
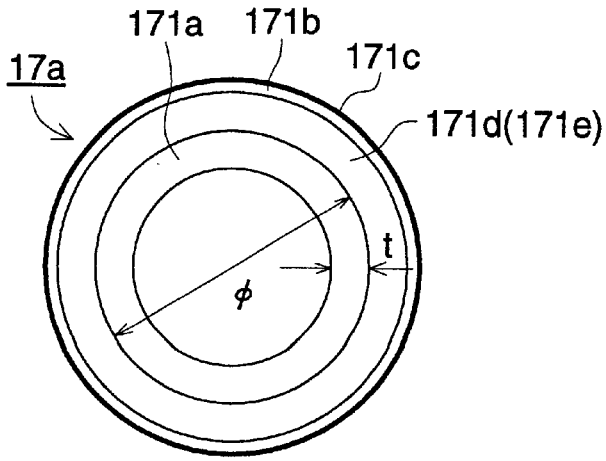

FIG. 6 is a diagram showing an outside diameter and a thickness of a ray-transmitting base member of the roll-shaped rotary member for applying heat in FIG. 3.

Figure 7:
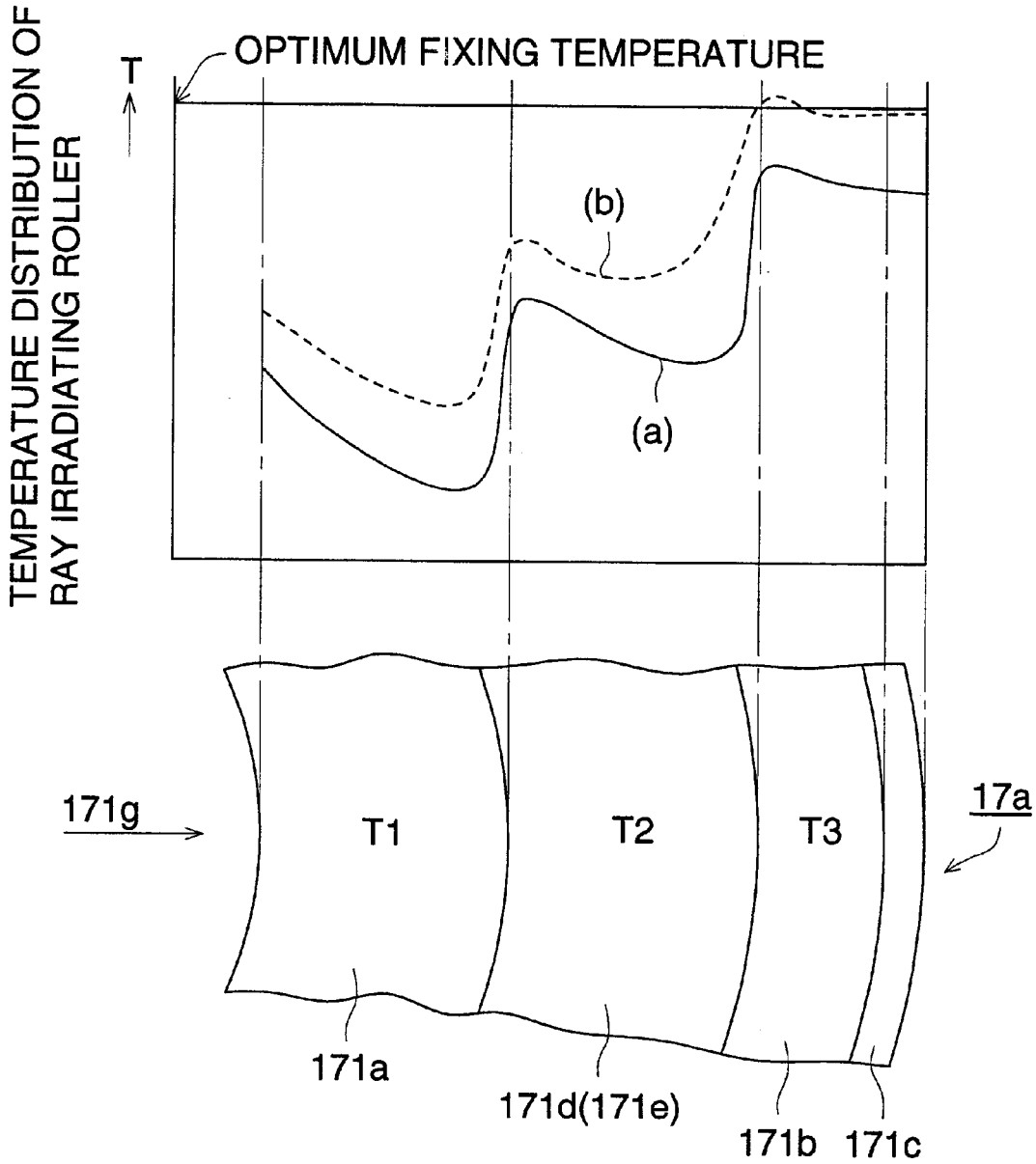

FIG. 7 is a diagram showing in-layer average temperature and temperature distribution both in each layer in the course of temperature rise of the rotary member for applying heat.

Figure 8:
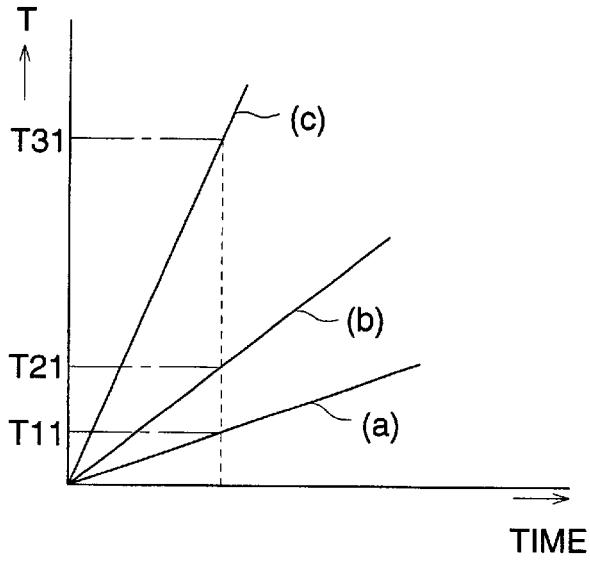

FIG. 8 is a diagram showing an inclination of a rising temperature in the course of temperature rise for each layer only of the rotary member for applying heat.

Figure 9:
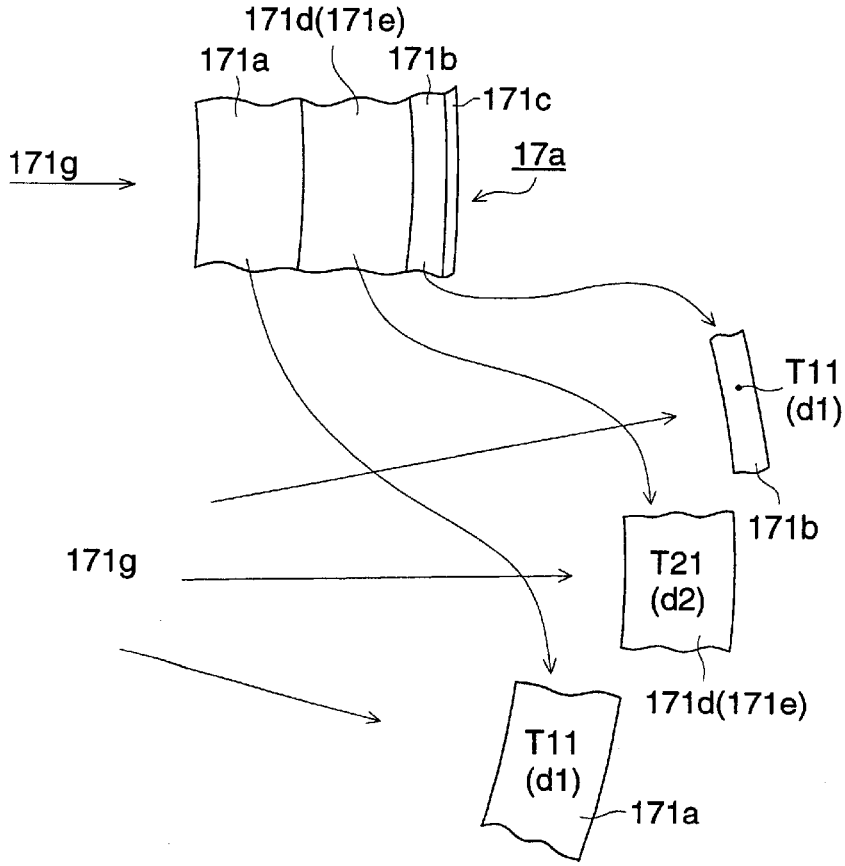

FIG. 9 is a diagram showing a rising temperature per unit time for a single layer only of a rotary member for applying heat and a ray absorption coefficient.

DETAILED DESCRIPTION OF THE PREFERRED EMBODIMENT

Figure 1:
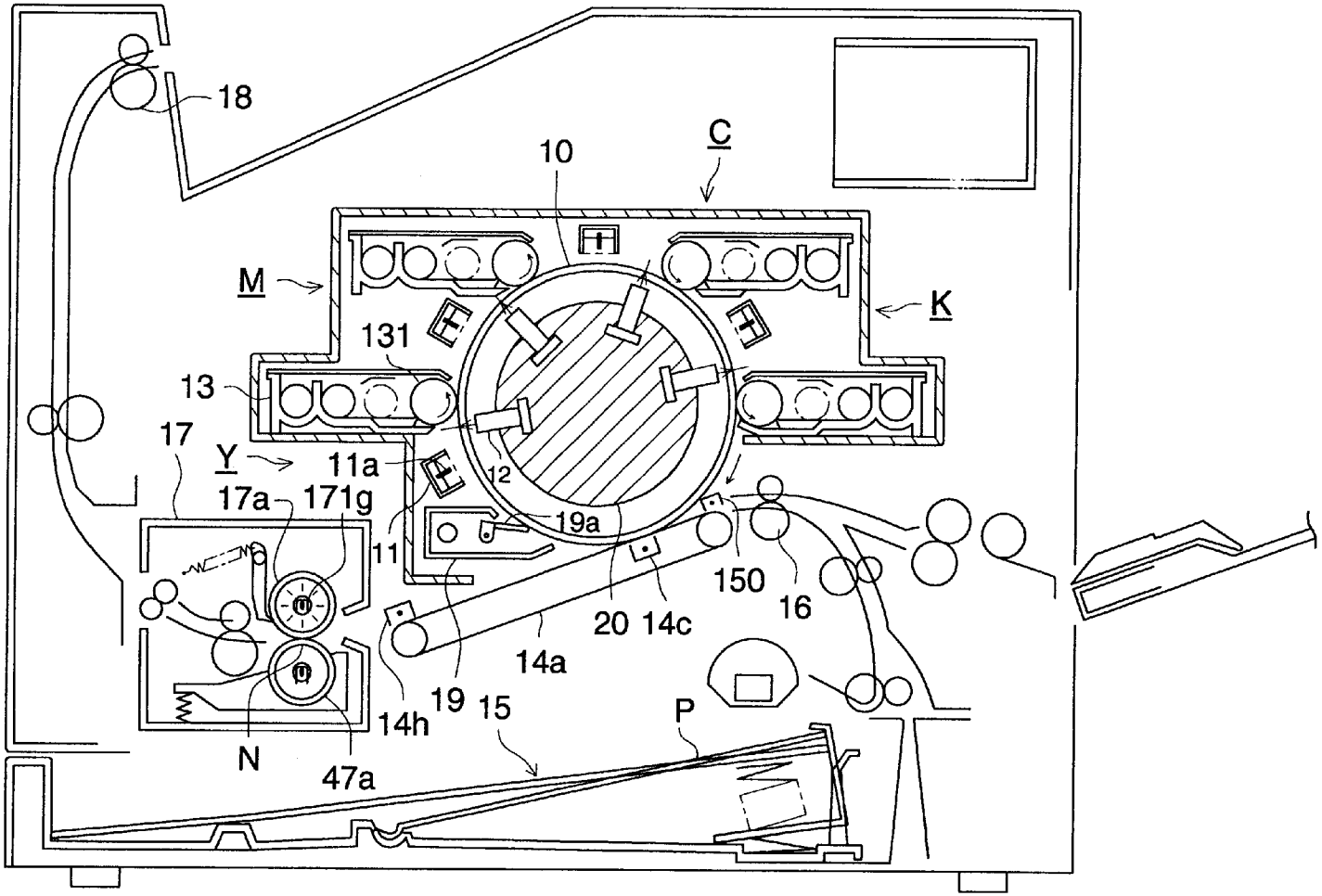
FIG. 1 is a sectional structure diagram of a color image forming apparatus showing an embodiment of an image forming apparatus related to the invention.

An image forming process and each mechanism in an embodiment of an image forming apparatus employing a fixing apparatus related to the invention will be explained as follows, referring to FIG. 1–FIG. 9. FIG. 1 is a sectional structure diagram of a color image forming apparatus showing an embodiment of an image forming apparatus related to the invention, FIG. 2 is a side sectional view of an image forming body in FIG. 1, FIG. 3 is an illustration showing the structure of a fixing apparatus, each of FIG. 4(*a*) and FIG. 4(*b*) is an enlarged sectional structure diagram of a roll-shaped rotary member for applying heat in FIG. 3, FIG. 5 is a diagram showing density distribution of a ray absorbing layer of the roll-shaped rotary member for applying heat in FIG. 3, FIG. 6 is a diagram showing an outside diameter and a thickness of a ray-transmitting base member of the roll-shaped rotary member for applying heat in FIG. 3, FIG. 7 is a diagram showing in-layer average temperature and temperature distribution both in each layer in the course of temperature rise of the rotary member for applying heat, FIG. 8 is a diagram showing an inclination of a rising temperature in the course of temperature rise for each layer only of the rotary member for applying heat and FIG. 9 is a diagram showing a rising temperature per unit time for a single layer only of a rotary member for applying heat and a ray absorption coefficient.

Figure 2:
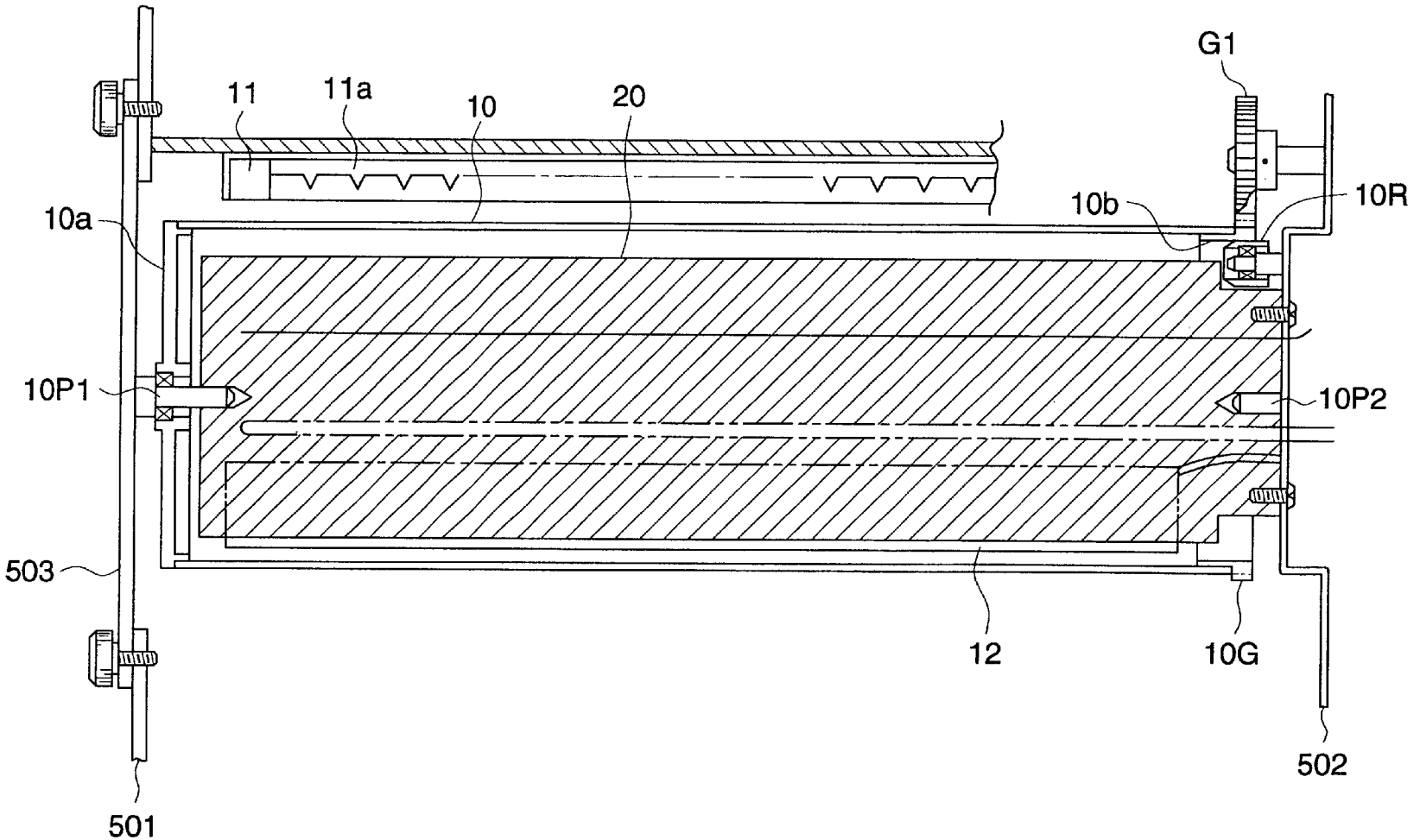
FIG. 2 is a side sectional view of an image forming body in FIG. 1.

According to FIG. 1 or FIG. 2, a photoreceptor drum 10 which is an image forming body, is formed in such a manner that, on the outer periphery of a cylindrical base body formed of a ray-transmitting member such as, for example, glass, acrylic resin, or the like, a light conductive material layer such as a ray-transmitting conductive layer or organic photoreceptor layer (OPC), is formed.

The photoreceptor drum 10 is rotated clockwise as shown by an arrow in FIG. 1 by the driving power from the driving source, not shown, while the ray-transmitting conductive layer is electrically grounded.

The photoreceptor drum 10 is held by a front flange 10*a* and a rear flange 10*b*, and the front flange 10*a* is supported by a bearing by a guide pin 10P1 provided on a cover 503 attached onto a front side plate 501 of the apparatus main body, and the rear flange 10*b* is engaged externally with a plurality of guide rollers 10R attached onto a rear side plate 502 of the apparatus main body, and the photoreceptor drum 10 is held. A gear IOG provided on the outer periphery of the rear flange 10*b* is engaged with the driving gear G1, and by its driving power, the photoreceptor drum 10 is rotated clockwise as shown by an arrow in FIG. 1 while the transparent conductive layer is electrically grounded.

In the present invention, in the light conductive layer of the photoreceptor drum which is an image forming point of the exposure beam for the image exposure, the transparent base body may have only an amount of exposure of the wavelength, which can form an appropriate contrast on the light damping characteristics (light carrier generation)of a. light conductive layer. Accordingly, it is not necessary that the light transparency factor of a transparent base body of the photoreceptor drum be 100%, but may have a characteristic in which some amount of light is absorbed at the time of transmission of the exposure beam, and the point is, it may be able to form an appropriate contrast on the light conductive layer. As light transmitting base body materials, acrylic resins, specifically; polymers incorporating a methyl methacrylate monomer, are excellent for the transparency, strength, accuracy, surface property, etc., and are preferably used. Further, any type of light transmissive resins such as acryl, fluorine, polyester, polycarbonate, polyethylene terephthalate, etc., which are used for general optical members, may be used. The material may even be colored if it still has light permeability with respect to the exposure light beams. As a light conductive layer, indium tin oxide (ITO), tin oxide, lead oxide, indium oxide, copper iodide, or a metallic film, in which light permeability is still maintained, and which is formed of Au, Ag, Ni, Al, etc., can be used. As film forming methods, a vacuum deposition method, an activated reaction deposition method, any type of spattering method, any type of CVD method, any dip coating method, any spray coating method, etc., can be used. As light conductive layers, any type of organic photoreceptor layer (OPC) can be used.

The organic photoreceptor layer as the light conductive photoreceptor layer is a two-layer structured photoreceptor layer, in which functions are separated into a charge generation layer (CGL) having a charge generating material (CGM) as a primary component, and into a charge transport layer (CTL) having a charge transporting material (CTM) as a primary component. The two-layer structured organic photoreceptor has a thick CTL, therefore, the durability as the organic photoreceptor is high, and thereby, it is appropriate for the present invention. Incidentally, the organic photoreceptor layer may be a single layer structure in which the charge generating material (CGM) and the charge transporting material (CTM)are included in one layer, and generally, binder resins are included in the single layer structured or the two-layer structured photoreceptor layer.

A scorotron charger 11 as a charging means, an exposure optical system 12 as an image writing means, and a developing unit 13 as a developing means, which will be described below, are respectively used in the image forming process of each color of yellow (Y), magenta (M), cyan (C) and black (K), and in the present embodiment, these are arranged in the order of Y, M, C and K in the direction of rotation of the photoreceptor drum 10 as shown by an arrow in FIG. 1.

The scorotron charger 11 as the charging means is mounted in the direction perpendicular to the movement direction of the photoreceptor drum 10 which is the image forming body, (in the vertical direction to the view in FIG. 1), opposed to the photoreceptor drum 10 and close to it, and a control grid (without numeral code) held at the predetermined potential to the organic photoreceptor layer of the photoreceptor drum 10, and as a corona discharging electrode 11*a*, for example, a saw-toothed electrode, are used, and a charging action (in the present embodiment, negative charging) is conducted by the corona discharge which is the same polarity as toner, and uniform electric potential is given to the photoreceptor drum 10. As the corona discharge electrode 11*a*, a wire electrode or a needle-like electrode may be used.

An exposure unit 12 is structured as a unit for the exposure, in which a linear exposure element (not shown) in which a plurality of LEDs (light emitting diodes) as a light emitting element for imagewise exposure lights are arrayed in parallel to the axis of the photoreceptor drum 10, and a Selfoc lens (not shown) as a life-sized image forming element, are attached onto a holder. The exposure optical system 12 for each color is attached onto a cylindrical holding member 20 which is fixed by being guided by a guide pin 10P2, provided on a rear side plate 502 of the apparatus main body, and another guide pin 10P1, provided on a cover 503 attached on a front side plate 501, and it is accommodated inside the base body of the photoreceptor drum 10. As the exposure elements, a linear exposure element in which a.plurality of light emitting elements such as Fls (fluorescent material emission elements), Els (electroluminescence elements), PLs (plasma discharge elements), etc., are aligned array-like, is used other than the above-described elements.

The exposure optical system 12 as the image writing means for each color is arranged inside the photoreceptor drum 10 in the state that the exposure position on the photoreceptor drum 10 is positioned between the scorotron charger 11 and the developing unit 13, and on the upstream side in the rotational direction of the photoreceptor drum to the developing unit 13.

The exposure optical system 12 conducts image processing according to image data for each color which is sent from a computer (not shown) and stored in a memory, and after that, conducts the image exposure onto the uniformly charged photoreceptor drum 10, and forms a latent image on the photoreceptor drum 10. The light emitting wavelength of the light emitting element used in the present embodiment is good within the range of 80–900 nm in which normally the light transparency of Y, M, C toners is high, however, because the image exposure is conducted from the rear surface, the wavelength shorter than this one, in which the light transparency is not so high for the color toner, may be used.

The developing unit 13 as the developing means for each color accommodates the two-component developer (the one-component developer may be allowable) of yellow (Y), magenta (M), cyan (C), or black (K) therein, and is respectively provided with the developing sleeve 131 which is a developing carrier formed of, for example, 0.5 mm to 1 mm thick, and 15 to 25 mm outer diameter cylindrical, non-magnetic stainless steel or aluminum material.

In a developing area, the developing sleeve 131 is kept non-contact with the photoreceptor drum 10 with a predetermined gap of, for example, 100 $\mu$m to 1000 $\mu$m, by a roller (not shown), and is rotated in the same direction as that of the photoreceptor drum 10. Onto the developing sleeve 131, when DC voltage with the same polarity as toner (in the present embodiment, negative polarity) or voltage in which AC voltage AC is superimposed on the DC voltage, is applied, the non-contact reversal development is conducted to the exposure portion of the photoreceptor drum 10. It is necessary that an accuracy of the development interval at the time is not larger than 20 $\mu$m in order to prevent the image unevenness.

As described above, the developing unit 13 reversal develops the electrostatic latent image on the photoreceptor drum 10, which is formed by the charge of the scorotron charger 11 and by the image exposure by the exposure optical system 12, in the state of non-contact, by the toner with the same polarity as the charged polarity of the photoreceptor drum 10 (in the present embodiment, the photoreceptor drum is charged negatively, and the toner has negative polarity).

When the image formation starts, by the start of the photoreceptor driving motor (not shown), a gear 10G provided on the rear flange 10*b* of the photoreceptor drum 10 is rotated through a gear G1 for driving, and the photoreceptor drum 10 is rotated clockwise as shown by an arrow in FIG. 1, and simultaneously, by the charging action of the Y scorotron charger 11, the electric potential is started to be given onto the photoreceptor drum 10. After the electric potential is given to the photoreceptor drum 10, in the Y exposure optical system 12, the exposure by the electric signal corresponding to the first color signal, that is, Y image data is started, the electrostatic latent image corresponding to the yellow (Y) image of the original image is formed on the photoreceptor layer of the surface of the photoreceptor drum 10 by the rotational scanning of the drum. This latent image is reversal-developed by the Y developing unit 13 in the state of non-contact, and the yellow(Y) toner image is formed on the photoreceptor drum 10.

Next, on the photoreceptor drum 10, the electric potential is applied on the yellow (Y) toner image by the charging action of the M scorotron charger 11, and the exposure is conducted by the electric signal corresponding tc the second color signal, that is, the magenta (M) image data of the M exposure optical system 12, and the magenta (M) atoner image is formed by being superimposed on the yellow (Y) toner image by the con-contact reversal development by the M developing unit 13.

By the same process, the cyan (C) toner image corresponding to the third color signal is formed by the C scorotron charger 11, the C exposure optical system 12, and the C developing unit 13, and the black(K) toner image corresponding to the fourth color signal is formed by the K scorotron charger 11, the K exposure optical system 12 and the K developing unit 13, wherein these toner images are formed by being respectively superimposed in order, and the color toner image is formed on the peripheral surface of the photoreceptor drum 10 during its one rotation.

As described above, in the present embodiment, the exposure onto the organic photoreceptor layer of the photoreceptor drum 10 by the Y, M, C and K exposure optical system 12 is conducted from the inside of the photoreceptor drum 10 through the transparent base body. Accordingly, any of the exposure of the image corresponding to the second, third and fourth color signals is not light-shielded by the previously formed toner image, and can form the electrostatic latent image and is preferable, however, the exposure may be conducted from the outside of the photoreceptor drum 10.

On the one hand, a recording sheet P as the transfer material is fed out by a feeding roller (without numeral code) from the sheet feed cassette 15 as a transfer material accommodation means, and is sent by a sending roller (without numerical code) to a timing roller 16.

The recording sheet P is in timed relationship with the color toner image carried on the photoreceptor drum 10 by the drive of the timing roller 16, and is attracted to a conveyance belt 14*a* by the charge of a paper charger 150 as a paper charging means, and sent to a transfer area. Onto the recording sheet P closely contacted and conveyed by the conveyance belt 14*a*, color toner images on the peripheral surface of the photoreceptor drum 10 are collectively transferred by the transfer unit 14*c* as a transfer means onto which the voltage with the reverse polarity to toner (in the present embodiment, positive polarity) is applied, in the transfer area.

The recording sheet P onto which color toner images are transferred, is discharged by a paper separation AC discharger 14*h* as a transfer material separation means, and separated from the conveyance belt 14*a* and conveyed to a fixing apparatus 17.

The fixing apparatus 17 is structured by a ray irradiating roller 17*a* as the upper side roll-shaped rotary member for applying heat to fix the color toner image, and a fixing roller 47*a* as the lower side roll-shaped rotary member for fixing, and at the center of the inside of the ray irradiating roller 17*a*, there is provided, as a ray radiating means, halogen lamp 171*g* or a xenon lamp (not shown) radiating the infra-red ray or far infra-red ray including visible light depending on a light source.

The recording sheet P is held in the nip portion N formed between the ray irradiating roller 17*a* and the fixing roller 47*a*, the color toner image on the recording sheet P is fixed by applying the heat and pressure, and the recording sheet P is sent to the sheet delivery roller 18 and delivered onto a tray on the upper portion of the apparatus.

The toner remaining on the peripheral surface of the photoreceptor drum after transfer is cleaned by a cleaning blade 19*a* provided on a cleaning device 19 as an image forming body cleaning means. The photoreceptor drum 10 from which the remaining toner is removed, is uniformly charged by the scorotron charger 11, and enters into the next image forming cycle.

As shown in FIG. 3, the fixing apparatus 17 is structured by a ray irradiating roller 17*a* as the upper side resilient roll-shaped rotary member for applying heat to fix the toner image on the transfer material, and a fixing roller 47*a* as the lower side roll-shaped rotary member for fixing, and the recording sheet P is held in the nip portion N with the width of about 5 to 20 mm, formed between the ray irradiating roller 17*a* and the fixing roller 47*a*, and the toner image on the recording sheet P is fixed by applying the heat and pressure. On the ray irradiating roller 17*a* as the roll-shaped rotary member for applying heat provided upside, in the rotational direction of the ray irradiating roller 17*a* from the position of the nip portion N, a fixing separation claw TR6, a fixing oil cleaning roller TR1, a heat uniformizing roller TR7, an oil coating felt TR2, and an oil amount regulating blade TR3 are provided, and the oil supplied from the oil tank TR4 to the oil coating felt TR2 through a capillary pipe TR5, is coated onto the ray irradiating roller 17*a* by the oil coating felt TR2. The oil on the peripheral surface on the ray irradiating roller 17*a* is cleaned by the fixing oil cleaning blade TR1. Accordingly, the heat uniformizing roller TR7, and a temperature sensor TS1 which is a temperature detecting sensor to measure the temperature of the ray irradiating roller 17*a*, and which will be described later, are provided on the cleaned peripheral surface of the ray irradiating roller 17*a* between the fixing oil cleaning roller TR1 and the oil coating felt TR2. The transfer material after fixing is separated by the fixing separation claw TR6. By the heat uniformizing roller TR7 using the metallic roller member having good thermal conductivity such as aluminum material, stainless material, etc. or the heat pipe, the heat generation temperature distribution of the peripheral surface of the ray irradiating roller 17*a* heated by the ray absorbing layer 171*b* is uniformized. By the heat uniformizing roller TR7, the longitudinal direction and lateral direction temperature unevenness of the ray irradiating roller 17*a* accompanied by the papering of the transfer material is uniformized.

The ray irradiating roller 17*a* as the rotary member for applying heat to fix the toner images on the transfer material is structured as a soft roller in which a cylindrical ray-transmitting base member 171*a*, the ray-transmitting resilient layer 171*d* (or ray-transmitting heat insulating layer 171*e*, which will be described later) on the outside (outer peripheral surface) of the ray-transmitting base member 171*a*, ray absorbing layer 171*b* and parting layer 171*c* are provided in this order. At the center of the inside of the ray irradiating roller 17*a*, there is provided, as a ray radiating means, halogen lamp 171*g* or a xenon lamp (not shown) radiating the infra-red ray or far infra-red ray including visible light depending on a light source. The ray irradiating roller 17*a* as the rotary member for applying heat is structured as a high resilient soft roller in the manner as will be described later. The ray radiated from the halogen lamp 171*g* or a xenon lamp (not shown) is absorbed by the ray absorbing layer 171*b*, and the quick heating practicable roll-shaped rotary member for applying heat is formed.

Further, the fixing roller 47*a* as the lower side roll-shaped rotary member for fixing is structured as a soft roller which is formed of, for example, a cylindrical metallic pipe 471*a* using the aluminum material, and a rubber roller 471*b* formed of a 1 to 3 mm thick thin wall rubber layer using, for example, a silicon material on the outer peripheral surface of the metallic pipe 471*a*. As the lower side roll-shaped rotary member for fixing, a high heat insulating resilient rubber roller (elastic roller employing foamed sponge material inside the roller) is used, and the diffusion of the heat from the upper side rotary member for applying heat to the lower side rotary member for fixing is prevented, and a wide nip width are assured. Further, a heat uniformizing roller TR7 using the metallic roller member having good thermal conductivity such as the aluminum material or stainless material, which comes into contact with the surface of the rubber roller 471*b* and is rotated, is provided, and by the heat uniformizing roller TR7, the heat generation temperature distribution of the peripheral surface of the fixing roller 47*a* is uniformized. As the heat uniformizing roller TR7, it is preferable that a heat pipe which has a heat accumulation and dissipation function, is used. Further, the halogen lamp 471*c* as the heat generating source may be provided at the center of the inside of the metallic pipe 471*a*. Of course, the same structure as the upper side ray irradiating roller 17*a* which is the present invention, may also be used for the lower side rotary member for fixing.

A plane-like nip portion N is formed between the upper side soft roller and the lower side soft roller and toner image is fixed.

TS1 is a temperature sensor which is a temperature detecting means using, for example, a contact type thermistor to conduct the temperature control, attached to the ray irradiating roller 17*a*, and TS2 is a temperature sensor using, for example, a contact type thermistor to conduct the temperature control, attached to the fixing roller 47*a*. As the temperature sensors TS1 and TS2, the non-contact type sensor may also be used other than the contact type sensor.

According to FIGS. 4(*a*) and 4(*b*), the structure of the ray irradiating roller 17*a* is as follows, as shown in the sectional view in FIG. 4(*a*), as the cylindrical ray-transmitting base member 171*a*, the thickness is 1 to 4 mm, preferably, 1.5 to 3 mm thick, and ceramic materials which absorb the ray of the infrared ray or far infrared radiation from the halogen lamp 171*g* or a xenon lamp (not shown) is transmitted, such as Pyrex glass, sapphire ($AL_2O_3$), CaF2, etc., (the thermal conductivity is (5 to 20)$\times 10^{-1}$ J/cm·s·K, the specific heat is (0.5 to 2.0)×J/g·K, and the specific gravity is 1.5 to 3.0), or ray transmitting resins using polyimide, polyamide, etc., (whose thermal conductivity is (2–4)$\times 10^{-3}$ J/cm·s·K, the specific heat is (1 to 2)×J/g·K, and the specific-gravity is 0.8 to 1.2), etc., are used. For example, as the ray transmitting base member 171*a* of the ray irradiating roller 17*a*, a thermal capacity Q1 per width of size A-3 (297 mm) of the ray transmitting base member 171*a* when Pyrex glass whose inner diameter is 32 mm, outer diameter is 40 mm and the layer thickness (thickness) is 4 mm, (specific heat is 0.78 J/g·K, the specific gravity is 2.32), is used, is about 60 cal/deg. Further, because the wavelength of the ray which transmits the ray transmitting base member 171*a* is 0.1 to 20 μm, preferably, 0.3 to 3 μm, conditioners for hardness or thermal conductivity are added as fillers, however, the ray-transmitting base member 171*a* may also be formed of the material in which fine particles of the following metallic oxide are dissipated in the resin binder, wherein fine particles of metallic oxide are those of the ray-transmitting (transmittable for infrared ray or far infrared radiation including visible light depending on a light source) ITO, titanium oxide, aluminum oxide, zinc oxide, silicon oxide, magnesium oxide, calcium carbonate, etc., whose particle size is not more than ½ of the wavelength of the ray, preferably, not more than ⅓, and whose average particle diameter including the primary and the secondary particles is not more than 1 μm, preferably, not more than 0.1 μm. In the layer, the fact that the average particle diameter including the primary and the secondary particles is not more than 1 μm, preferably, not more than 0.1 μm, is preferable to prevent the light from scattering so that the light reaches the ray absorbing layer 171*b*. As described above, the thermal conductivity of the ray-transmitting base member 171*a* is not so good.

Further, since a cylindrical glass member (ceramic material) is used mainly as a material of the ray-transmitting base member 171*a*, the cylindrical accuracy (circularity and cylindricity of a peripheral cylinder) of the ray-transmitting base member 171*a* is poor (see FIG. 3), dispersion of circularity and cylindricity of the peripheral cylinder is 0.1 mm or more under the normal state, and pressure force and rotation of the ray-transmitting base member 171*a* become uneven, which tends to cause uneven fixing. These are not on the condition to be utilized, and they need to be absorbed. Therefore, a layer thickness of elastic layer 171*d* is made to be three times or more the circularity of the peripheral cylinder of the ray-transmitting base member 171*a*. Due to this, the problems mentioned above can be solved. It is further preferable that circularity of the peripheral cylinder of the ray-transmitting base member 171*a* is kept to be not more than 0.8 mm. It is also preferable that even the cylindricity is kept to be not more than 0.8 mm. When circularity and cylindricity of the peripheral cylinder exceed 0.8 mm, uneven fixing can not be absorbed despite presence of elastic layer 171*d*.

As stated above, since a cylindrical glass member (ceramic material) is used mainly as a material of the ray-transmitting base member 171*a*, the cylindrical accuracy (circularity and cylindricity of a peripheral cylinder) of the ray-transmitting base member 171*a* is poor (see FIG. 3), pressure force and rotation become uneven, which tends to cause uneven fixing. Therefore, ray-transmitting elastic layer 171*d* is provided on the outer circumferential surface of the ray-transmitting base member 171*a*. With regard to the ray-transmitting elastic layer 171*d* provided on the outer circumferential surface of the ray-transmitting base member 171*a*, it is preferable that a thickness of the elastic layer 171*d* is not less than three times the circularity or cylindricity of the peripheral cylinder of the ray-transmitting base member 171*a* so that the thickness of the elastic layer 171*d* may cover dispersion of circularity and cylindricity of the ray-transmitting base member 171*a*. The thickness (lay thickness) which is from 1 mm to 10 mm is preferable, and that from 2 mm to 5 mm is more preferable, and the ray-transmitting base member is formed by a ray-transmitting (light-transmitting) rubber layer (base layer) employing, for example, silicone rubber or fluorine-contained rubber, and transmitting the aforesaid rays (infrared rays or far-infrared rays including visible light, depending on a light source). When the thickness of the elastic layer 171*d* is less than 1 mm, uneven fixing can not be absorbed. When the thickness exceeds 10 mm, heat capacity grows greater to cause a warming-up time to be too long, although uneven fixing can be absorbed. Further, when it exceeds 10 mm, the rays do not reach ray absorbing layer 171*b* due to light absorption (ray absorption) at elastic layer 171*d*, though the elastic layer 171*d* is ray-transmitting. For forming the elastic layer 171*d*, a method wherein centered ray-transmitting base member 171*a* is put in a mold, and then, rubber liquid is injected in the outer portion (outer circumferential surface) of the ray-transmitting base member so that the rubber liquid may be bridged to form ray-transmitting elastic layer 171*d*, is preferable because outside diameter accuracy (circularity and cylindricity of a peripheral cylinder) which is especially high can be obtained. In this way, ray-transmitting elastic layer 171*d* having high accuracy for circularity and cylindricity of a peripheral cylinder is formed on the outside (outer circumferential surface) of the ray-transmitting base member 171*a*. In this case, as will be stated later, it is also possible to make the ray-transmitting elastic layer 171*d* to be ray-absorbent, and thereby to make the elastic layer 171*d* to be ray-transmitting and ray-absorbent. In that case, the elastic layer is made to be of a 3-layer structure wherein ray absorbing layer 171*b* is provided on the outside (outer circumferential surface) of the ray-transmitting elastic layer 171*d* in a method of coating or a method of a tube.

The ray-transmitting resilient layer 171*d* is formed of ray-transmitting rubber layer (base layer) which absorbs the ray at the ray energy absorption rate, which will be described later, and transmits the remained ray (infrared ray or far infrared ray including visible light depending on a light source), in which 1 to 4 mm thick, preferably, 2 to 3 mm thick, for example, silicon rubber or fluorine rubber is used. As the ray-transmitting resilient layer 171*d*, for the high speed operation, a method by which the thermal conductivity is increased by mixing powders of metallic oxide such as silica, alumina, magnesium oxide, etc., in the base layer (silicon rubber), is adopted, and a rubber layer in which the thermal conductivity is (1 to 3)$\times 10^{-3}$ J/cm·s·K, specific heat is (1 to 2)×J/g·K, and the specific gravity is 0.9 to 1.0, is used. For example, as the ray-transmitting resilient layer 171*d* of the ray irradiating roller 17*a*, a thermal capacity Q2 per width of size A-3 (297 mm) of the ray-transmitting resilient layer 171*d* when silicon rubber whose outer diameter is 48 mm and the layer thickness (thickness) is 4 mm, (specific heat is 1.1 J/g·K, the specific gravity is 0.91), is used, is about 40 cal/deg. The thermal conductivity of the rubber layer is lower by one figure than that of the ray-transmitting base member 171*a* using the glass member (the thermal conductivity is (5 to 20)$\times 10^{-3}$ J/cm·s·K) and therefore, the rubber layer plays a role of a layer having the heat insulation property. When the thermal conductivity is increased, generally there is the tendency in which the hardness of the rubber is increased, and for example, normally the hardness 40 Hs of the rubber is increased to near 60 Hs (JIS, A rubber hardness). The preferable rubber hardness is 5 to 60 Hs. Almost portion of the ray-transmitting resilient layer 171*d* of the rotary member for applying heat is covered by this base layer, and the compressed amount at the pressing time is determined by the rubber hardness of the base layer. On the intermediate layer of the ray-transmitting resilient layer 171*d*, fluorine-contained rubber as the oil resistant layer to prevent oil swelling is coated with the thickness of 20 to 300 $\mu$m. As the silicon rubber of a top layer of the ray-transmitting resilient layer 171*d*, RTV (Room Temperature Volcanizing) or LTV (Low Temperature Volcanizing) whose parting property is better than HTV (High Temperature Volcanizing), is covered in the same thickness of the intermediate layer. Further, because the wavelength of the ray which passes through the ray-transmitting resilient layer 171*d* is 0.1 to 20 $\mu$m, preferably, 0.3 to 3 $\mu$m. as the conditioner for the hardness or thermal conductivity, the ray-transmitting resilient layer 171*d* may be formed of the material in which fine particles of the following metallic oxide are dissipated in the resin binder, wherein fine particles of metallic oxide are those of the ray transmitting (transmittable for infrared ray or far infrared radiation including visible light depending on a light source) titanium oxide, aluminum oxide, zinc oxide, silicon oxide, magnesium oxide, calcium carbonate, etc., whose particle size is not more than ½ of the wavelength of the ray, preferably, not more than ⅕, and whose average particle diameter including the primary and the secondary particles is not more than 1 $\mu$m, preferably, not more than 0.1 $\mu$m. In the layer, the fact that the average particle diameter including the primary and the secondary particles is not more than 1 $\mu$m, preferably, not more than 0.1 $\mu$m, is preferable to prevent the light from scattering so that the light reaches the ray absorbing layer 171*b*. By providing the ray-transmitting resilient layer 171*d*, the ray irradiating roller 17*a* as the rotary member for applying heat is structured as a high resilient soft roller. Further, as the ray irradiating roller 17*a* which is the rotary member for applying heat of the present invention, instead of the ray-transmitting resilient layer 171*d* having heat insulating property, a ray-transmitting heat insulating layer 171*e* which has an effect of only the heat insulating property as a non-resilient layer of ray-transmitting resins, or the like, can also be used.

With regard to the elastic layer 171*d*, it is also possible to mix the powder of carbon black, graphite, iron black ($Fe_3O_4$), various types of ferrite and its compounds, copper oxide, cobalt oxide, and red iron oxide ($Fe_2O_3$) in a base layer (silicone rubber) wherein the powder of metal oxide such as silica, aluminum oxide, and magnesium oxide is combined as a filler, so that the elastic layer may also be ray-absorbent in addition to ray-transmitting.

As ray-absorbing layer 171*b*, in the remained portion of the ray, which is radiated by the halogen lamp 171*g* or a xenon lamp (not shown) and absorbed in the ray-transmitting base member 171*a* and ray-transmitting resilient layer 171*d* (or the ray-transmitting heat insulating layer 171*e*), in order to attain that the ray of 90 to 100%, preferably 95 to 100%, which is corresponding to almost 100% of the ray which transmits through the ray-transmitting base member 171*a* and ray-transmitting resilient layer 171*d* (or the ray-transmitting heat insulating layer 171*e*), is absorbed by the ray-absorbing layer 171*b*, and the instantaneous heating practicable rotary member for applying heat is formed, the ray absorbing member in which powders of carbon black, graphite, iron black ($Fe_3O_4$), or each kind of ferrite and its compound, copper oxide, cobalt oxide, red oxide ($Fe_2O_3$), etc., are mixed in the resin binder, is used, and 100 to 500 $\mu$m thick, preferably 200 to 400 $\mu$m thick ray absorbing member is formed on the outside (on the outer peripheral surface) of the ray-transmitting resilient layer 171*d* (or the ray-transmitting heat insulating layer i71*e*) by spraying or coating. The thermal conductivity of the ray absorbing layer 171*b* can be set to a slightly higher value of (3 to 10)$\times 10^{-3}$ J/cm·s·K (specific heat is (up to 2.0)×J/g·K, specific gravity is (up to 0.9) by the addition of absorbent such as carbon black, or the like, as compared to the rubber layer of the ray-transmitting resilient layer 171*d* (the thermal conductivity is (1 to 3)$\times 10^{-3}$ J/cm·s·K, specific heat is (1 to 2)×J/g·K, specific gravity is 0.9 to 1.0). As the ray absorbing layer 171*b*, the metallic roller member such as nickel electroforming roller, or the like, may be provided with the same thickness. In this case, in order to absorb the ray, it is preferable that the inside (inner peripheral surface) is black oxide-processed. When the ray absorbing rate in the ray absorbing layer 171*b* is lower-than about 90%, and when about 20 to 80%, the ray breaks through the layer, and by the ray which breaks through the layer, in the case where the ray irradiating roller 17*a* as the rotary member for applying heat is used for the monochromatic image formation, when the black toner is adhered on the surface of the specific position of the ray irradiating roller 17*a* by filming, or the like, the heat generation occurs from the adhered portion by the ray which breaks through the layer, and the heat generation by the ray absorption further occurs at that portion, and thereby, the ray absorbing layer 171*b* is broken. Further, when it is used for the color image formation, generally, the absorption rate of the color toner is low, and because there is a difference of absorption rate between color toners, the fixing failure or fixing unevenness occurs. Accordingly, in the remained portion of the ray, which is radiated by the halogen lamp 171*g* or a xenon lamp (not shown) and absorbed in the ray-transmitting base member 171*a* and ray-transmitting resilient layer 171*d* (or the ray-transmitting heat insulating layer 171*e*), the ray absorption rate of the ray absorbing layer 171*b* is made 90 to 100%, preferably 95 to 100%, which is corresponding to almost 100% of the ray, so that the ray which transmits through the ray-transmitting base member 171*a* and ray-transmitting resilient layer 171*d* (or the ray-transmitting heat insulating layer 171*e*),is perfectly absorbed in the ray absorbing layer 171*b*. Thereby, the fusion of the color toner which is difficult to fix by the ray because the spectral characteristics are different, can be fairly conducted, and particularly, in the color image formation in FIG. 1, the fusion of the superimposed color toner images on the transfer material, on which the toner layer is thick, and which is difficult to fix by the ray because the spectral characteristics are different, can be fairly conducted. Further, when the thickness of the ray absorbing layer 171*b* is not more than 100 μm and thin, the heating speed by the absorption of the ray in the ray absorbing layer 171*b* is high, however, it becomes a cause of breakage or a short of strength of the ray absorbing layer 171*b* by the local heating due to thin film, and when the thickness of the ray absorbing layer 171*b* exceeds 500 μm and too thick, the thermal conductivity becomes poor, or the thermal capacity becomes large and quick heating can hardly conducted. When the ray absorption rate of the ray absorbing layer 171*b* is made 90 to 100%, preferably 95 to 100%, which is corresponding to almost 100% of the ray, or when the thickness of the ray absorbing layer 171*b* is made 100 to 500 μm, preferably 200 to 400 μm, the local heat generation in the ray absorbing layer 171*b* is prevented, and heat generation can be uniformly conducted. Further, because the wavelength of the ray radiated onto the ray absorbing layer 171*b* is 0.1 to 20 μm, preferably 0.3 to 3 μm, the conditioner for the hardness or thermal conductivity is added as filler, however, the ray absorbing layer 171*b* may be formed of the material in which fine particles of the following metallic oxide are dissipated in the resin binder by 5 to 50 wt %, wherein fine particles of metallic oxide are those of the ray transmitting (transmittable for infrared ray or far infrared radiation including visible light depending on a light source) titanium oxide, aluminum oxide, zinc oxide, silicon oxide, magnesium oxide, calcium carbonate, etc., whose particle size is not more than ½ of the wavelength of the ray, preferably, not more than ⅕, and whose average particle diameter including the primary and the secondary particles is not more than 1 μm, preferably, not more than 0.1 μm. As described above, because the thermal capacity of the ray absorbing layer 171*b* is made small so that the temperature rises soon, the problem that the temperature lowering occurs in the ray irradiating roller 17*a* as the rotary member for applying heat, and uneven fixing is generated, is prevented. As the ray absorbing layer 171*b*, the material in which powders of carbon black, graphite, iron black ($Fe_3O_4$), or each kind of ferrite and its compound, copper oxide, cobalt oxide, red oxide ($Fe_2O_3$), etc., are mixed in the resilient silicon rubber or fluorine rubber, may also be used. For example, as the ray absorbing layer 171*b* (or a combined use layer 171B, which will be described later) of the ray irradiating roller 17*a*, a thermal capacity Q3 per width of size A-3 (297 mm) of the ray absorbing layer 171*b* (or the combined use layer 171B) when fluorine resin whose layer thickness (thickness) is 100 μm, (specific heat is 2.0 J/g·K, the specific gravity is 0.9), is used on the surface (outer peripheral surface) of the ray-transmitting resilient layer having the outer diameter of 48 mm, is about 1.0 cal/deg. As the ray absorbing layer 171*b*, the metallic film member such as nickel electroforming belt, may be used. In this case, in order to absorb the ray, it is preferable that the inside (inner peripheral surface) is black oxide-processed.

Further, PFA (fluorine resin) tube with the thickness of 30 to 100 μm is covered on the outside (outer peripheral surface) of the ray absorbing layer 171*b*, separating from the ray absorbing layer 171*b*, in order to make the parting property from the toner good, or the parting layer 171*c* (thermal conductivity is $(1–10)\times10^{-3}$ J/cm·s·K, specific heat is (up to 2.0)×J/g·K, and specific gravity is (up to 0.9)) on which fluorine resin (PFA or PTFE) paint is coated to 20 to 30 μm, is provided (separation type).

Further, as shown in the sectional view in FIG. 4(*b*), the ray absorbing member, in which powders of carbon black, graphite, iron black ($Fe_3O_4$), or each kind of ferrite and its compound, copper oxide, cobalt oxide, red oxide ($Fe_2O_3$), etc., are mixed, and the resilient roll-shaped rotary member for applying heat may also be formed in such a manner that fluorine resin (PFA or PTFE) paint which combinedly has the binder and parting agent, is mixed and blended, and in FIG. 4(*a*), the ray absorbing layer 171*b* and the parting layer 171*c* are integrated, and a combined use layer 171B having the parting property is formed outside (outer peripheral surface) of the ray-transmitting resilient layer 171*d* (or ray-transmitting heat insulating layer 171*e*) formed outside (outer peripheral surface) the ray-transmitting base member 171*a*. The thermal conductivity of the combined use layer 171B is almost the same as the thermal conductivity of the ray absorbing layer 171*b* and $(3–10)\times10^{-3}$ J/cm·s·K (specific heat is (up to 2.0)×J/g·K, specific gravity is (up to 0.9)). In the same manner as described above, in the remained portion of the ray, which is-radiated by-the halogen lamp 171*g* or a xenon lamp (not shown) and absorbed in the ray-transmitting base member 171*a* and ray-transmitting resilient layer 171*d* (or the ray-transmitting heat insulating layer 171*e*), the ray absorption rate of the combined use layer 171B is made 90 to 100%, preferably 95 to 100%, which. is corresponding to almost 100% of the ray, so that the ray which transmits through the ray-transmitting base member 171*a* and ray-transmitting resilient layer 171*d* (or the ray-transmitting heat insulating layer 171*e*), is perfectly absorbed. When the ray absorbing rate in the combined use layer 171B is lower than about 90%, and for example, when about 20 to 80%, the ray breaks through the layer, and by the ray which breaks through the layer, in the case where the rotary member for applying heat is used for the monochromatic image formation, when the black toner is adhered on the surface of the specific position of the rotary member for applying heat by filming, or the like, the heat generation occurs from the adhered portion by the ray which breaks through the layer, and furthermore, the heat generation by. the ray absorption further occurs at that portion, and thereby, the combined use layer 171B is broken. Further, when it is used for the color image formation, generally, the absorption efficiency of the color toner is low, and because there is a difference of absorption efficiency between color toners, the fixing failure or fixing unevenness occurs. Accordingly, in the remained portion of the ray, which is radiated by the halogen lamp 171*g* or a xenon lamp (not shown) and absorbed in the ray-transmitting base member 171*a* and ray-transmitting resilient layer 171*d* (or the ray-transmitting heat insulating layer 171*e*), the ray absorption rate of the combined use layer 171B is made 90 to 100%, preferably 95–100%, which is corresponding to almost 100% of the ray, so that the ray which transmits through the ray-transmitting base member 171*a* and ray-transmitting resilient layer 171*d* (or the ray-transmitting heat insulating layer 171*e*), is perfectly absorbed in the rotary member for applying heat. Further, the local heat generation in the combined use layer 171B is also prevented, and heat generation can be uniformly conducted. Further, because the wavelength of the ray radiated onto the combined use layer 171B is 0.1–20 μm. preferably 0.3 to 3 μm, the conditioner for the hardness or thermal conductivity is added as filler, however, the combined use layer 171B may be formed of the material in which fine particles of the following metallic oxide are dissipated in the resin binder, wherein fine particles of metallic oxide are those of the ray transmitting (mainly infrared ray or far infrared radiation transmittable) titanium oxide, aluminum oxide, zinc oxide, silicon oxide, magnesium oxide, calcium carbonate, etc., whose particle size is not more than ½ of the wavelength of the ray, preferably, not more than ⅕, and whose average particle diameter including the primary and the secondary particles is not more than 1 μm, preferably, not more than 0.1 μm.

According to FIG. 5, when the density distribution of the ray absorbing member is uniformly provided on the ray absorbing layer 171*b* of the ray irradiating roller 17*a* as the roll-shaped rotary member for applying heat, heat generation concentrates on the ray absorbing layer 171*b* which is in the boundary, and the heat flows out to the ray-transmitting resilient layer 171*d* (or the ray-transmitting heat insulating layer 171*e*) side, therefore, it is preferable from the viewpoint of the dispersion of the distribution of the heat. generation that the low thermal conductive member is used rather than ray-transmitting base member 171*a*, or that the density distribution is provided and the heat is generated inside the ray absorbing layer 171*b*. The density distribution of the ray absorbing layer 171*b* is as shown in the graph (A), the interface of the inscribing ray-transmitting resilient layer 171*d* (or the ray-transmitting heat insulating layer 171*e*) side is in the low density, and the distribution is sloped so that it is successively heightened toward the outer peripheral surface, and the density is made such that the ray of 100% is absorbed just before the outer peripheral surface side (at the position of about ⅔–⅘ from the ray-transmitting resilient layer 171*d* (or the ray-transmitting heat insulating layer 171*e*) to the thickness t of the ray absorbing layer 171*b*), and is saturated. According to this, the distribution of the heat generation by the ray absorption in the ray absorbing layer 171*b* is, as shown in the graph (B), formed into the parabolic-shape, which has the maximum value in the vicinity of the central portion of the ray absorbing layer 171*b* and the minimum values on the interface of the ray absorbing layer 171*b* or in the vicinity of the outer peripheral surface. Or it is preferable that the ray-transmitting heat resistive resin (polyimide, fluorine containing resin, or silicon resin) with 10 to 500 μm thickness, preferably 20 to 100 μm is provided on the interface of the ray absorbing layer 171*b* or outer peripheral surface. Further, it is preferable that the low thermal conductive member is used rather than the ray-transmitting base member 171*a* and the flow out of the heat is suppressed. According to this, the heat generation due to the ray absorption on the interface is made small, and the breakage of the adhering layer on the interface or the breakage of the ray absorbing layer 171*b* is prevented. The density distribution from just before the outer peripheral surface side (at the position of about ⅔–⅘ from the ray-transmitting base member 171*a* side(or the ray-transmitting heat insulating layer 171*e*) to the thickness t of the ray absorbing layer 171*b*), to the outer peripheral surface is made saturated, and particularly, even when the combined use layer 171B is used, it is made to give no influence even if the outer peripheral surface layer is rubbed out. Incidentally, as shown by a dotted line, the saturation layer may also be formed. In summary, when the absorption is fully conducted inside, there is no influence of the density outside. The influence of rubbing out is not generated also. Further, the slope is provided in the density distribution, and by changing the angle of the slope, the distribution of the heat generation can be adjusted.

Further, as shown in FIG. 6, as the outer diameter ϕ of the cylindrical ray-transmitting base member 171*a* of the ray irradiating roller 17*a* as the roll-shaped rotary member for applying heat, a 15 to 60 mm member is used, and as the thickness t, the thick member is better for its strength, and the thin member is better for its thermal capacity, but, from the relationship between the strength and thermal capacity, the relationship of the outer diameter ϕ and the thickness t of the cylindrical ray-transmitting base member is $0.025 \leqq t/\phi \leqq 0.10$, and preferably, $0.035 \leqq t/\phi \leqq 0.07$.

When the outer diameter ϕ of the ray-transmitting base member 171*a* is 40 mm, the thickness t of the ray-transmitting base member 171*a* is 1 mm$\leqq$t$\leqq$4 mm, preferably, 1.4 mm$\leqq$t$\leqq$2.8 mm. When t/ϕ of the ray-transmitting base member 171*a* is not larger than 0.025, the strength is insufficient, and when t/ϕ exceeds 0.10, the thermal capacity is too large, the heating of the ray irradiating roller 17*a* takes a long period of time. Further, in the ray-transmitting base member, there is a case in which the ray of about 1 to 20% is absorbed depending on the material, and the thinner one is preferable within the range in which the strength can be maintained.

When the fixing apparatus 17 as described in FIG. 3 is used, the fixing apparatus which is strong for deformation in the fixing portion (nip portion), and can conduct the quick start (quick heating), can be provided, and further, due to the pressure in the soft fixing portion (nip portion) by the elasticity of the rotary member for applying heat and heating by the ray-absorbing layer of the rotary member for applying heat, because the spectral characteristics are different, the fusing of the color toner which is difficult to be fixed by the ray is conducted fairly, and the quick start (quick heating) of the color toner can be conducted. Further, the energy saving effect can be obtained.

In accordance with FIG. 7, in the conventional fixing apparatus, as stated in the beginning, the method using only heat generation from the ray absorbing layer on the surface has problems that the temperature of the lower portion of the ray absorbing layer is low, and the temperature of the ray absorbing layer suddenly falls when making prints, and the hysteresis on the portion where a transfer material passes remains for a long time, causing temperature fluctuation on the rotary member for applying heat, although the warming-up time can be shortened.

As shown in FIG. 7, therefore, in-layer average temperature of each layer in temperature rise caused by rays of halogen lamp 171*g* or a xenon lamp (not shown) in the case of forming ray irradiating roller 17*a* is established to become higher in the order of ray-transmitting base member 171*a*, ray-transmitting elastic layer 171*d* (or, ray-transmitting heat insulating layer 171*e*) and ray absorbing layer 171*b*, without limiting only to the ray absorbing layer 171*b* on the surface. Namely, it is preferable to establish to keep the relationship of T1<T2<T3, when T1 (°) represents in-layer average temperature of ray-transmitting base member 171*a*, T2 (°) represents in-layer average temperature of ray-transmitting elastic layer 171*d* or ray-transmitting heat insulating layer 171*c*, and T2 (°) represents in-layer average temperature of ray-transmitting elastic layer 171*d* or ray-transmitting heat insulating layer 171*c*, and T3 (°) represents. in-layer average temperature of ray absorbing layer 171*b*, all in the case the fixing apparatus is warmed up. Due to this, it is possible to prevent that the temperature of the ray absorbing layer suddenly falls when making prints, and the hysteresis on the portion where a transfer material passes remains for a long time, causing temperature fluctuation on the rotary member for applying heat. With regard to temperature distribution in temperature rise of ray irradiating roller 17*a* in this case, temperature distribution in the initial stage of heating is one shown by curve (a) in FIG. 7, because heat generation on the part of ray absorbing layer 171*b* is more than that on the part of inner ray-transmitting base member 171*a* and ray-transmitting elastic layer 171*d* (or, ray-transmitting heat insulating layer 171*e*), in the initial stage of heating, thus, it is chilly inside the rotary member for applying heat, and temperature therein is low, though the ray absorbing layer 171*b* on the surface can be raised rapidly in terms of temperature. The inner temperature of the ray-transmitting base member 171*a* is especially low. The temperature distribution in the late stage turns into one shown by curve (b) in FIG. 7, and the ray-transmitting base member 171*a* in the rotary member for applying heat is made to be low in terms of temperature, although the ray absorbing layer 171*b* on the surface is already raised to the appropriate temperature for fixing and ray-transmitting elastic layer 171*d* (or, ray-transmitting heat insulating layer 171*e*) also is raised in terms of temperature to be close to the appropriate temperature for fixing.

When the average temperature in each layer in the course of temperature rise in the structure of a rotary member for applying heat is established to be higher in the order of a ray-transmitting base member, a ray-transmitting elastic layer or a ray-transmitting heat insulating layer and a ray absorbing layer, ray absorption at a certain level is conducted not only in the ray absorbing layer on the surface but also in the ray-transmitting base member and the ray-transmitting elastic layer in the lower layer or the ray-transmitting heat insulating layer, thus, a temperature fall. in the ray absorbing layer in the course of printing and temperature hysteresis at the portion though which a transfer material passes are prevented, and thereby, a temperature of the rotary member for applying heat is stabilized, and warming-up time can be shortened.

In accordance with FIG. 8 or FIG. 9, in the conventional fixing apparatus, as stated at the beginning, heat generation of a ray absorbing layer on the surface alone causes problems that temperature in the lower layer of the ray absorbing layer is low, and thereby, temperature of the ray absorbing layer falls suddenly in the course of printing, hysteresis on the portion through which a transfer material passes remains for a long time, and temperature fluctuation is caused on the rotary member for applying heat.

Therefore, when forming as ray irradiating roller 17*a* as stated in FIG. 7, it is necessary to give consideration to ray absorption conducted by a member inside ray absorbing layer 171*b*. Straight line (a) in FIG. 8 shows a temperature inclination in temperature rising on only a single layer of ray-transmitting base member 171*a*, straight line (b) in FIG. 8 shows a temperature inclination in temperature rising on only a single layer of ray-transmitting elastic layer 171*d* (or, ray-transmitting heat insulating layer 171*e*) and straight line (c) in FIG. 8 shows a temperature inclination in temperature rising on only a single layer of ray absorbing layer 171*b*, and FIG. 9 shows rising temperatures caused by rays of halogen lamp 171*g* or a xenon lamp (not shown) per unit time for a single layer (rising temperature per unit time for each layer irradiated by rays individually). It is preferable to establish so that the relationship of $$T11<T21<T31$$

may be kept, when T11 (°) represents a rising temperature per unit time for only ray-transmitting base member 171*a*, T21 (°) represents a rising temperature per unit time for only ray-transmitting elastic layer 171*d* or ray-transmitting heat insulating layer 171*e*, and T31 (°) represents a rising temperature per unit time for only ray absorbing layer 171*b*. This establishment prevents that a temperature of the ray absorbing layer falls in a short period of time in the course of printing, hysteresis on the portion through which a transfer material passes remains for a long time, and temperature fluctuation is caused on the rotary member for applying heat. It is more preferable to have the relationship of $T21>2\times T11$, $T31>10\times T11$, $T31>5\times T21$, and this prevents that a temperature of the ray absorbing layer falls in a short period of time in the course of printing, hysteresis on the portion through which a transfer material passes remains for a long time, and temperature fluctuation is caused on the rotary member for applying heat.

When rising temperature per unit time for each layer alone in temperature rising (rising temperature per unit tine for each layer irradiated by rays individually) is established to be higher in the order of a ray-transmitting base member, a ray-transmitting elastic layer or a ray-transmitting heat insulating layer and a ray absorbing layer, a temperature fall of the ray absorbing layer in the course of printing, and temperature and hysteresis on the portion through which a transfer material passes are prevented, a temperature of a rotary member for applying heat is stabilized, and warming-up time can be shortened.

Further, FIG. 9 shows a ray absorption coefficient for each single layer, and when $\alpha 1$ ($mm^{-1}$) represents a ray absorption coefficient of ray-transmitting base member 171*a*, $\alpha 2$ ($mm^{-1}$) represents a ray absorption coefficient of ray-transmitting elastic layer 171*d* or ray-transmitting heat insulating layer 171*e* and $\alpha 3$ ($mm^{-1}$) represents a ray absorption coefficient of ray absorbing layer 171*b*, it is preferable to establish to satisfy the following.

$$\alpha 1<\alpha 2<\alpha 3$$

This establishment prevents that a temperature of the ray absorbing layer falls in a short period of time in the course of printing, hysteresis on the portion through which a transfer material passes remains for a long time, and temperature fluctuation is caused on the rotary member for applying heat.

In general, a rate of transmitted light L to supplied light $L_0$ in a member having thickness of x, namely, a transmission factor (%) for ray absorption coefficient $\alpha$ ($mm^{-1}$) is expressed by the following, $$L/L_0=e^{-(\alpha \cdot x)}$$

and transmission factor of about 75% or more is preferable for ray-transmitting base member 171*a* having a thickness of 1 to 4 mm. When assuming that $\alpha 1$ ($mm^{-1}$) represents a ray absorption coefficient of the ray-transmitting base member 171*a*, ray absorption coefficient $\alpha 1$ of the ray-transmitting base member 171*a* having a thickness, for example, of 1 mm is; 0.29 $mm^{-1}$, while, ray absorption coefficient $\alpha 1$ of the ray-transmitting base member 171*a* having a thickness of 4 mm is 0.07 $mm^{-1}$. It is therefore more preferable that ray absorption coefficient $\alpha 1$ of ray-transmitting base member 171*a* is established to satisfy the following.

$$\alpha 1<0.30\ mm^{-1}$$

is preferable that a transmission factor of ray-transmitting elastic layer 171*d* (or, ray-transmitting heat insulating layer 171*e*) having a thickness of 1 to 4 mm is approximately 20–60%. When assuming that $\alpha 2$ ($mm^{-1}$) represents a ray absorption coefficient of ray-transmitting elastic layer 171*d* (or, ray-transmitting heat insulating layer 171*e*), ray absorption coefficient $\alpha 2$ of ray-transmitting elastic layer 171*d* (or, ray-transmitting heat insulating layer 171*e*) having a thickness of 1 mm at the transmission factor of 20%, for example, is 1.6 $mm^{-1}$, and ray absorption coefficient $\alpha 2$ of ray-transmitting elastic layer 171*d* (or, ray-transmitting heat insulating layer 171*e*) having a thickness of 4 mm is 0.4 $mm^{-1}$. Further, ray absorption coefficient $\alpha 2$ of ray-transmitting elastic layer 171*d* (or, ray-transmitting heat insulating layer 171*e*) having a thickness of 1 mm at the transmission factor of 60% is 0.52 $mm^{-1}$, and ray absorption coefficient $\alpha 2$ of-ray-transmitting elastic layer 171*d* (or, ray-transmitting heat insulating layer 171*e*) having a thickness of 4 mm is 0.13 $mm^{-1}$. It is therefore preferable to select a thickness of ray-transmitting elastic layer 171*d* (or, ray-transmitting heat insulating layer 171*e*) appropriately and thereby to establish ray absorption coefficient $\alpha 2$ to satisfy the following.

$$0.1\ mm^{-1}=\alpha 2=2.0\ mm^{-1}$$

It is more preferable, from the relationship with ray absorption coefficient $\alpha 1$ of ray-transmitting base member 171*a*, to establish to satisfy the following.

$$0.3\ mm^{-1}=\alpha 2=2.0\ mm^{-1}$$

The transmission factor of ray absorbing layer 171*b* having a thickness of 25 to 500 $\mu$m is preferably 1% or less. When $\alpha 3$ ($mm^{-1}$) represents a ray absorption coefficient of ray absorbing layer 171*b*, ray absorption coefficient $\alpha 3$ of ray absorbing layer 171*b* having a thickness of 25 $\mu$m for example, is 184 $mm^{-1}$ and ray absorption coefficient $\alpha 3$ of ray absorbing layer 171*b* having a thickness of 500 $\mu$m is 9.2 $mm^{-1}$. It is therefore preferable that ray absorption coefficient $\alpha 3$ is established to satisfy the following.

$$\alpha 3=9.0\ mm^{-1}$$

In the foregoing, each ray absorption coefficient (absorption coefficient) has an absorption coefficient which is dependent on a light source, because spectral characteristics of a light source (a halogen lamp and a xenon lamp) are different from others. Further, the aforesaid ray absorption coefficient (absorption efficient) is an effective absorption coefficient of light energy wherein spectral characteristics are taken into consideration. In place of obtaining from the transmission factor, it is also possible to obtain effective absorption coefficient from the rate of temperature rise of each layer in FIG. 8.

From the foregoing, when the ray absorption coefficient for each layer alone in temperature rising is established to be higher in the order of a ray-transmitting base member, a ray-transmitting elastic layer or a ray-transmitting heat insulating layer and a ray absorbing layer, ray absorption at a certain level is conducted not only in the ray absorbing layer on the surface but also in the ray-transmitting base member and the ray-transmitting elastic layer in the lower layer or the ray-transmitting heat insulating layer, thus, a temperature fall in the ray absorbing layer in the course of printing and temperature hysteresis at the portion though which a transfer material passes are prevented, and thereby, a temperature of the rotary member for applying heat is stabilized.

In the invention, when average temperature in each layer in temperature rising in the case of constituting as a rotary member for applying heat is established to be higher in the order of a ray-transmitting base member, a ray-transmitting elastic layer or a ray-transmitting heat insulating layer and a ray absorbing layer, ray absorption at a certain level is conducted not only in the ray absorbing layer on the surface but also in the ray-transmitting base member and the ray-transmitting elastic layer in the lower layer or the ray-transmitting heat insulating layer, thus, at temperature fall in the ray absorbing layer in the course of printing and temperature hysteresis at the portion though which a transfer material passes are prevented, and thereby, a temperature of the rotary member for applying heat is stabilized, and warming-up time can be shortened.

In the invention, when rising temperature per unit time for each layer alone in temperature rising (rising temperature per unit time for each layer irradiated by rays individually) is established to be higher in the order of a ray-transmitting base member, a ray-transmitting elastic layer or a ray-transmitting heat insulating layer and a ray absorbing layer, ray absorption at a certain level is conducted not only in the ray absorbing layer on the surface but also in the ray-transmitting base member and the ray-transmitting elastic layer in the lower layer or the ray-transmitting heat insulating layer, thus, a temperature fall in the ray absorbing layer in the course of printing and temperature hysteresis at the portion though which a transfer material passes are prevented, and thereby, a temperature of the rotary member for applying heat is stabilized, and warming-up time can be shortened.

In the invention, when the ray absorption coefficient for each layer alone in temperature rising is established to be higher in the order of a ray-transmitting base member, a ray-transmitting elastic layer or a ray-transmitting heat insulating layer and a ray absorbing layer, ray absorption at a certain level is conducted not only in the ray absorbing layer on the surface but also in the ray-transmitting base member and the ray-transmitting elastic layer in the lower layer or the ray-transmitting heat insulating layer, thus, a temperature fall in the ray absorbing layer in the course of printing and temperature hysteresis at the portion though which a transfer material passes are prevented, and thereby, a temperature of the rotary member for applying heat is stabilized.

Owing to the foregoing, there is formed a rotary member for applying heat having excellent cylindrical accuracy such as circularity and cylindricity of a peripheral cylinder, resulting in uniform pressure force and rotation of the rotary member for applying heat, thus, there is provided a fixing apparatus equipped with a rotary member for applying heat wherein uneven fixing is prevented, energy conservation is kept, warming-up time is short and quick start (instant heating) is possible.

In the invention, a rotary member for applying heat having excellent cylindrical accuracy such as circularity and cylindricity of a peripheral cylinder is formed, resulting in uniform pressure force and rotation of the rotary member for applying heat, and uneven fixing is prevented.

What is claimed is:

1. A fixing apparatus for fixing a toner image on a transfer material through heating and pressing, the fixing apparatus comprising:

(a) a ray-radiating means for radiating rays; and (b) a roll-shaped rotary member for applying heat including (1) a cylindrical ray-transmitting base member for transmitting the rays, (2) a cylindrical ray-transmitting elastic layer or a ray-transmitting heat insulating layer for transmitting the rays, and (3) a ray absorbing layer provided on an outer side of the elastic layer or the ray-transmitting heat insulating layer for absorbing the rays, wherein the following inequality is satisfied, $$T1<T2<T3$$

where T1 (°) represents an average temperature in the layer of the ray-transmitting base member, T2 (°) represents an average temperature in the layer of the ray-transmitting elastic layer or the ray-transmitting heat insulating layer, and T3 (°) represents an average temperature in the layer of the ray absorbing layer during a warm-up.

2. The fixing apparatus of claim 1, wherein thickness of the cylindrical ray-transmitting base member is 1 to 4 mm.

3. The fixing apparatus of claim 1, wherein thickness of the cylindrical ray-transmitting elastic layer is 1 to 4 mm.

4. The fixing apparatus of claim 1, wherein thickness of the ray absorbing layer is 100 to 500 $\mu$m.

5. A fixing apparatus for fixing a toner image on a transfer material through heating and pressing, the fixing apparatus comprising:

(a) a ray-radiating means for radiating rays; and (b) a roll-shaped rotary member for applying heat including (1) a cylindrical ray-transmitting base member for transmitting the rays, (2) a cylindrical ray-transmitting elastic layer or a ray-transmitting heat insulating layer for transmitting the rays, and (3) a ray absorbing layer provided on an outer side of the elastic layer or the ray-transmitting heat insulating layer for absorbing the rays, wherein the following inequality is satisfied, $$T11<T21<T31$$

where T11 (°) represents a temperature raised per unit time for the ray-transmitting base member alone, T21 (°) represents a temperature raised per unit time for the ray-transmitting elastic layer or the ray-transmitting heat insulating layer alone, and T31 (°) represents a temperature raised per unit time for the ray absorbing layer alone.

6. The fixing apparatus of claim 5, wherein the following inequality is satisfied, $$T21>2\cdot T11.$$

7. The fixing apparatus of claim 5, wherein the following inequality is satisfied, $$T31>10\cdot T11.$$

8. The fixing apparatus of claim 5, wherein the following inequality is satisfied, $$T31>5\cdot T21.$$

9. A fixing apparatus for fixing a toner image on a transfer material through heating and pressing, the fixing apparatus comprising:

(a) a ray-radiating means for radiating rays; and (b) a roll-shaped rotary member for applying heat including (1) a cylindrical ray-transmitting base member for transmitting the rays, (2) a cylindrical ray-transmitting elastic layer or a ray-transmitting heat insulating layer for transmitting the rays, and (3) a ray absorbing layer provided on an outer side of the elastic layer or the ray-transmitting heat insulating layer for absorbing the rays, wherein the following inequality is satisfied, $$\alpha1<\alpha2<\alpha3$$

where $\alpha1$ ($mm^{-1}$) represents the ray absorption coefficient of the ray-transmitting base member, $\alpha2$ ($mm^{-1}$) represents the ray absorbtion coefficient of the ray-transmitting elastic layer or the ray-transmitting heat insulating layer, and $\alpha3$ ($mm^{-1}$) represents the ray absorption coefficient of the ray absorbing layer.

10. The fixing apparatus of claim 9, wherein the followings inequality is satisfied, $$\alpha1<0.30\ mm^{-1}.$$

11. The fixing apparatus of claim 9, wherein the following inequality is satisfied, $$0.1\ mm^{-1}\leqq\alpha2\leqq2.0\ mm^{-1}.$$

12. The fixing apparatus of claim 9, wherein the inequality is satisfied, $$\alpha3\geqq9.0\ mm^{-1}.$$

* * * * *